United States Patent [19]

Hoppe

[11] 4,439,046

[45] Mar. 27, 1984

[54] TIME INTERPOLATOR

[75] Inventor: David R. Hoppe, McHenry, Ill.

[73] Assignee: Motorola Inc., Schaumburg, Ill.

[21] Appl. No.: 414,769

[22] Filed: Sep. 7, 1982

[51] Int. Cl.[3] ..... G04F 8/00

[52] U.S. Cl. ..... 368/120

[58] Field of Search ..... 368/113–120; 235/92 T; 343/5 DP, 8

[56] References Cited

U.S. PATENT DOCUMENTS 3,675,127 7/1972 McKiernan ..... 368/119

3,983,481 9/1976 Nutt et al. ..... 368/118

4,234,881 11/1980 Stauers ..... 343/8

*Primary Examiner*—Vit W. Miska

*Attorney, Agent, or Firm*—Eugene A. Parsons

[57] ABSTRACT

A vernier system for digitally measuring elapsed time between a start and stop pulse against a system clock reference where the start pulse is synchronized with the clock. Fractional parts of the clock pulse at stop time are interpolated by means of a tapped delay line connected to a plurality of latch circuits which provide the least significant bits by way of a read-only-memory look-up table.

3 Claims, 1 Drawing Figure

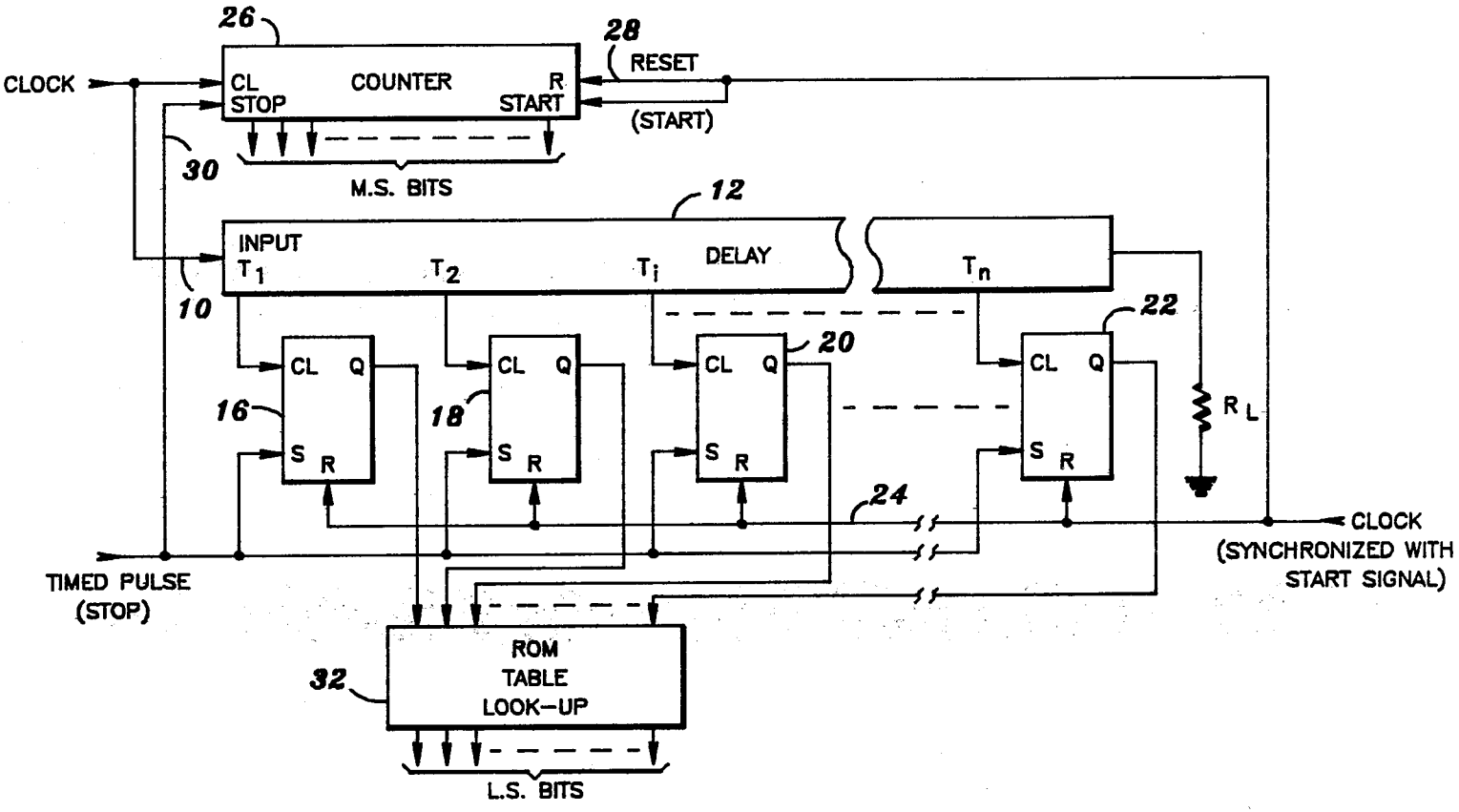
CLOCK
(SYNCHRONIZED WITH START SIGNAL)
$R_L$
22
Q
CL
S
R
$T_n$
24
20
DELAY
12
RESET
(START)
28
$T_i$
COUNTER
START
M.S. BITS
$T_2$
18
ROM TABLE LOOK-UP
L.S. BITS
32
INPUT
$T_1$
16
26
CL
STOP
30
10
CLOCK
TIMED PULSE (STOP)

TIME INTERPOLATOR

FIELD OF THE INVENTION

The invention relates to an improved pulse timing system which uses a delay interpolator to decrease the effective resolution error in the timing system.

BACKGROUND OF THE INVENTION

There are a number of applications which require accurate measurement from a start to a stop pulse, such as, for example, a TOA (Time of Arrival) pulse in a radar system. Where extreme accuracy has been required for such a measurement, typically a very high speed clock has been used to drive a counter. The accuracy has been limited by the resolution attained. The resolution of such a system is limited by clock speed (repetition rate), the upper limit of the counter rate. The resolution accuracy was never better than the period of the clock pulse repetition rate.

SUMMARY OF THE INVENTION

The limited resolution available from prior art digital pulse timing systems is improved by means of the use of a delay interpolator in the present invention. The time between input clock pulses is effectively divided by a factor of n by means of a delay device having taps where the clock period divided by n is equal to or greater than the aperture time of a series of n latches or D flip-flops which are connected to the taps of the delay device.

The output of the n latches is interpreted by a table look-up device to provide the least significant bits (L.S.B.) for the system output measurement while the most signficant bits (M.S.B.) are taken from a more conventional digital counter which is driven from the same system clock from which the delay device is driven.

It is, therefore, an object of the instant invention to provide improved resolution in a pulse timing measurement system by employing a delay device with n taps to effectively improve system resolution by a factor of approximately n.

It is another object of the invention to improve the resolution of a pulse timing system by a factor of approximately n while at the same time reducing power consumption.

These and other objects of the invention will be better understood upon study of the Detailed Description of the Invention, infra, together with the drawings in which:

The drawing is a block diagram of a preferred embodiment of the invention.

DETAILED DESCRIPTION OF THE INVENTION

The invention comprises an improved circuit for measuring the time of an input pulse with respect to a system clock signal. The circuit to be described allows measurement of additional least significant bits which may be utilized to improve the resolution of a conventional start/stop digital elapsed time counter, or another such device which might be used for the same purpose. In a conventional counter, the start pulse may be synchronized with the system clock in order to avoid the necessity for measuring frictional clock cycles at start time. However, in that case, the stop pulse may not be so synchronized and there is a resolution error induced unless some method is used to record fractions of the clock cycle at the system "stop" time. The instant invention provides such a fractional measurement at low cost and complexity.

Referring to the drawing, a system clock signal is applied to input terminal 10 of delay line 12 which is properly terminated by load resistor $R_L$. Delay line 12 has n taps, $T_1$, $T_2$ - - - Ti - - - Tn. Each tap is delayed by Tn/n where Tn is the total delay and n is the number of taps. The total delay, Tn, and the taps Ti must be chosen so that the delays between all adjacent taps are equal (for linear results) and so that the total delay is at least as great as the period of the clock signal.

Each delay tap, Ti, is connected to the latch clock input of latch circuits 16, 18, 20 and 22, as shown in the drawing. Latch circuits 16, 18 20 and 22 are reset by the same system reset signal 24 which is used to reset system digital counter 26 on line 28. The stop signal is applied on line 30 to system digital counter 26 and to each of the n latches as typified by 16, 18, 20 and 22, all simultaneously. Latches 16, 18, 20 and 22 are chosen to respond to system reset 24 with a "zero" output at the Q terminal of each latch. The delayed clock inputs at each of latch circuits 16, 18, 20 and 22 enable the latch to sample the time phase of the timed pulse on line 30.

Of course, n must be chosen so that there is no possibility of lack of coincidence at all latches; there must be coincidence at at least one latch. This may be accomplished if the clock period divided by n ($p_c/n$) is at least as great as the shortest time aperture at any one of latches 16, 18, 20 and 22. Since it would be nearly impossible to make $P_c/n$ exactly equal to the time aperture of every latch because there will always be small variations in the various latch, delay line and pulse characteristics, $P_c/n$ is chosen to always guarantee a small time overlap. This means that it is possible to actuate more than one latch to the "one" state. The resolution of the system can be maintained at nearly the ideal level, however, if these "one"s are in adjacent latches; as will be seen, infra.

All "Q" outputs from the n latches 16, 18, 20 and 22 are fed in parallel to ROM (read only memory) 32. ROM 32 is programmed to output a binary digital code representative of the transition point from "zero" to "one" in any two adjacent latch circuits. At the conclusion of the stop pulse on line 30, some latch connected to delay line 12 at tap $T_i$ will be set to "zero" and the next latch down delay line 12 at tap Ti+1 will be set to "one". This code pattern indicates the L.S.B. (least significant bits) out of ROM 32 to within:

$$\Delta T = T_{i+1} - T_i$$

where ΔT is the resolution time error. Counter 26 provides the M.S.B. (most significant bits) in the conventional manner.

For example, a system may employ n latches=10 so that a 100 nanosecond clock period is resolved down to approximately 10 nanoseconds (100/n) by means of the circuit of the invention. The 100 nanosecond intervals are available in digital form from digital counter 26 and 10 nanosecond intervals are generated digitally out of ROM 32. The ten input lines to ROM 32 are converted therein to four output lines coded to exhibit 0–9 increments. Of course, other parameters may be chosen depending on specific system requirements.

The invention provides a fractional clock period measurement accuracy without the need for extremely high speed digital components. The delay line/latch arrangement of the invention provides a vernier sort of measurement based on a much courser clock period. The improvement in resolution is nearly equal to n where is the number of taps and associated digital latches on the delay line.

While the invention has been particularly shown and described with reference to a preferred embodiment thereof, it will be understood by those skilled in the art that various other modifications and changes may be made to the present invention from the principles of the invention described above without departing from the spirit and scope thereof, as encompassed in the accompanying claims. Therefore it is intended in the appended claims to cover all such equivalent variations as come within the scope of the invention as described.

I claim:

1. An improved resolution circuit for a digital elapsed time measuring circuit which utilizes a system clock signal as a time standard, wherein the improvement comprises:

tapped delay means for delaying the clock signal, said delay means being driven by the clock signal, said delay means having a plurality of n taps;

a plurality of n latch means for capturing the time of arrival of the clock signal, each of said plurality of latch means having a clock signal input terminal, each of said clock signal input terminals being connected to a different one of said plurality of n taps, each of said plurality of latch means having a stop pulse input terminal and an output terminal, a signal on said output terminal being responsive to a time coincidence of said time of arrival of the clock signal and of said stop pulse; and means for converting said time coincidence to a digitally coded output signal corresponding to said time coincidence.

2. The improved circuit according to claim 1 wherein said converting means comprises a read only memory device having n input address lines and at least one output line for indication at least one least significant bit.

3. A system for measuring the elapsed time between a start pulse and a stop pulse wherein a system clock signal is synchronized with the start pulse, comprising:

a digital counter, said counter being responsive to the system clock signal, the start signal and the stop signal to generate a signal set representative of a set of most significant bits of the elapsed time;

tapped delay means for delaying the system clock signal, said delay means having an input and n output taps, said delay means being driven at said input by the system clock signal and providing n different delayed clock signal outputs on said n taps;

n latch means for capturing a time of arrival of said delayed clock signal and for comparing said time of arrival of said delayed clock signal with the stop pulses, each of said n latch means having a clock input connected to a different one of said n output taps and each of said n latch means having an input connected to the stop pulse, each of said n latch means being responsive to time coincidence of said system clock pulse and to the stop pulse to set an output of said each of said n latch means to a predetermined code state, said predetermined code state being different from another code state of said output in the absence of said time coincidence; and means for converting any predetermined output code state pattern from said n latch means to a set of least significant bits representative of and responsive to said time coincidence.

* * * * *